US007408298B2

(12) United States Patent
Kato et al.

(10) Patent No.: US 7,408,298 B2
(45) Date of Patent: Aug. 5, 2008

(54) IMAGE DISPLAY DEVICE

(75) Inventors: Kenji Kato, Mobara (JP); Yuuichi Kijima, Chose (JP); Yoshiyuki Kaneko, Hachioji (JP); Shigemi Hirasawa, Chiba (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 110 days.

(21) Appl. No.: 11/319,167

(22) Filed: Dec. 28, 2005

(65) Prior Publication Data

US 2006/0138954 A1 Jun. 29, 2006

(30) Foreign Application Priority Data

Dec. 28, 2004 (JP) ..... 2004-380360
Jan. 11, 2005 (JP) ..... 2005-003383

(51) Int. Cl.
*H01J 17/24* (2006.01)
*H01J 19/70* (2006.01)
*H01J 61/26* (2006.01)

(52) U.S. Cl. ..... 313/561; 313/496; 313/553

(58) Field of Classification Search ..... 313/553, 313/558–561, 481, 293–304, 495–497, 306, 313/309–310, 346, 351, 355
See application file for complete search history.

(56) References Cited

U.S. PATENT DOCUMENTS 5,635,795 A * 6/1997 Itoh et al. ..... 313/496
5,789,858 A * 8/1998 Itoh et al. ..... 313/495
5,977,706 A * 11/1999 Cho et al. ..... 313/553
6,039,620 A * 3/2000 Itoh et al. ..... 445/25
6,084,344 A * 7/2000 Kishino et al. ..... 313/495
6,114,806 A * 9/2000 Itoh ..... 313/553
6,194,830 B1 * 2/2001 Cho et al. ..... 313/553
6,603,260 B1 * 8/2003 Kim et al. ..... 313/562
6,670,753 B1 * 12/2003 Hatano ..... 313/553
2004/0169469 A1 * 9/2004 Hasegawa ..... 313/553
2006/0043870 A1 * 3/2006 Tsuda et al. ..... 313/495
2006/0043871 A1 * 3/2006 Kamio et al. ..... 313/495

* cited by examiner

*Primary Examiner*—Mariceli Santiago
*Assistant Examiner*—Jose M Diaz
(74) *Attorney, Agent, or Firm*—Antonelli, Terry, Stout & Kraus, LLP.

(57) ABSTRACT

On a back surface of a back substrate on which electron emission sources are formed, a getter room is formed by the back substrate and a cup-shaped room member. In the inside of the getter room, a getter assembly which includes a getter housing which holds a getter and a getter support which supports the getter housing is arranged. End portions of the getter support are fixed to and arranged between the back substrate and the room member by a sealing material. The present invention provides an image display device which prevents the occurrence of cracks in the getter room thus suppressing the degradation of a display characteristic of the image display device.

14 Claims, 13 Drawing Sheets

IMAGE DISPLAY DEVICE

CROSS-REFERENCE TO RELATED APPLICATION

The present application claims priority from Japanese application JP2004-380360 filed on Dec. 28, 2004, and Japanese application JP2005-003383 filed on Jan. 11, 2005, the content of which is hereby incorporated by references into this application

BACKGROUND OF THE INVENTION

1. Field of the Invention

The present invention relates to an image display device, and more particularly to an image display device which includes a getter device, and to be more specific, the arrangement structure of a getter which is arranged in the inside of a getter device.

2. Description of the Related Art

As an image display device which performs a display by allowing electrons to impinge on a phosphor screen so as to make the phosphor screen emit lights, there has been known, for example, a field emission image display device which includes field emission electron sources, a thin film CRT (Thin Cathode Ray Tube) as represented by a surface-transmission-type image display device including surface-transmission-type electron sources, a cathode ray tube, or the like. This type of image display device is requested to hold a high degree of vacuum in the inside of a vessel so as to facilitate the movement of electrons.

In a conventional image display device, a getter is arranged on a plane coplanar with a plane of a back substrate on which electron sources are formed. When the getter is formed on the same plane as the electron sources, a display region part is formed with a small area or only a region where the getter is formed must be formed in an enlarged manner. Further, with respect to the evaporation-type getter, when the getter is arranged in the inside of an activated environment (a space in which electron sources are formed), electron emission portions of the electron sources are covered with a getter film thus reducing the electron emission ability.

Japanese Patent Laid-open 2003-528422 (patent document 1) discloses a means to cope with the above-mentioned drawback by forming a getter room in a state that the getter room is bonded to a display screen side of a display device. Further, Japanese Patent Laid-open Hei 9(1997)-129161 (patent document 2) discloses a means to cope with the above-mentioned drawback by forming a getter room in a state that the getter room is bonded to a back surface side of the display device.

SUMMARY OF THE INVENTION

The above-mentioned patent document 1 discloses an image display device having the structure which prevents electron emission portions from being exposed to the getter by arranging the getter in an auxiliary chamber (a getter room). However, with respect to the image display device having such a constitution, a drawback attributed to the heating of the getter at the time of getter flash is not taken into consideration at all.

Further, since the getter which is housed in a housing is directly mounted on a glass-made getter room member, when the getter is heated by a high-frequency heating device, the housing is also heated simultaneously. Here, the difference exists between a heat expansion quantity of the housing and a heat expansion quantity of the getter room and hence, cracks are generated in a mounting portion between the housing and the getter room thus giving rise to a drawback that the display characteristic of the image display device is degraded.

Further, when the arrangement position of the getter is changed, the heating state of the getter is changed and hence, the getter material does not sufficiently scatter. As a result, the performance of the getter film is deteriorated and the adsorption of the residual gas becomes insufficient. Still further, there also exists a drawback that the getter barium intrudes the electron emitting portion via a through hole thus inducing the deterioration of spark and emission in the inside of the display panel.

An image display device according to the present invention includes a vacuum envelope in which a back substrate which forms a plurality of electron emission sources thereon and a face substrate which forms an anode and phosphor layers on an inner surface thereof which faces an electron emission source forming surface of the back substrate are arranged to face each other with a given distance therebetween, and a space defined between the back substrate and the face substrate is hermetically sealed. To a back surface of the back substrate, a getter room which is communicated with the vacuum envelope is provided. A room member which constitutes the getter room is hermetically bonded by way of a sealing material. In the inside of the getter room, a getter assembly is arranged. The getter assembly includes a getter, a getter housing which holds the getter, and a getter support which supports the getter housing. The getter housing is arranged in the inside of the getter room in a state that the getter housing is supported on the getter support, while the getter support is fixed between the back substrate and the room member by way of the sealing material. Due to the above-mentioned constitution, it is possible to overcome the drawbacks of the related art.

Due to such a constitution, according to the present invention, it is possible to provide an image display device which can suppress the degradation of the display characteristic by preventing the occurrence of cracks in the getter room.

An image display device according to the present invention includes a vacuum envelope in which a back substrate which forms a plurality of electron emission sources thereon and a face substrate which forms an anode and phosphors on an inner surface thereof which faces an electron emission source forming surface of the back substrate are arranged to face each other with a given distance therebetween, and a space defined between the back substrate and the face substrate is hermetically sealed. To a back surface of the back substrate, a getter room which is communicated with the vacuum envelope is provided. A room member which constitutes the getter room is hermetically bonded to the vacuum envelope by way of a sealing material and a getter assembly is arranged in the inside of the getter room. The getter assembly includes a getter, a getter housing which holds the getter, and a getter support which supports the getter housing, and a positioning rod which sets an arrangement position of the getter, and a positioning groove which allows the insertion of a distal end portion of the positioning rod therein is formed in the inside of the room member. By allowing the distal end portion of the positioning rod to be inserted into the positioning groove, it is possible to stabilize the positioning of the getter.

Further, with respect to another image display device according to the present invention, preferably, in the above-mentioned constitution, a through hole is formed in the back substrate and the getter room is communicated with the vacuum envelope via the through hole.

Further, with respect to another preferred image display device according to the present invention, in the above-mentioned constitution, by arranging the getter in the vicinity of a bottom surface portion of the room member, it is possible to overcome the drawbacks of the related art.

Further, with respect to another preferred image display device according to the present invention, in the above-mentioned constitution, by arranging the housing in a spaced-apart manner from a bottom surface portion of the room member, it is possible to overcome the drawbacks of the related art.

Further, with respect to another preferred image display device according to the present invention, in the above-mentioned constitution, by arranging the getter in a state that the getter faces a back surface of the back substrate, it is possible to overcome the drawbacks of the related art.

Further, with respect to another preferred image display device according to the present invention, in the above-mentioned constitution, by arranging an end portion of the getter support between the back substrate and an opening end of the room member, it is possible to overcome the drawbacks of the related art.

Further, with respect to another preferred image display device according to the present invention, in the above-mentioned constitution, the getter support includes a flange portion and the flange portion is fixedly mounted on the housing by way of a sealing material and hence, it is possible to overcome the drawbacks of the related art.

Further, with respect to another preferred image display device according to the present invention, in the above-mentioned constitution, a plurality of pairs of getter supports are provided and the respective flange portions of the plurality of getter supports are fixedly mounted on the housing by way of the sealing material and hence, it is possible to overcome the drawbacks of the related art.

Further, with respect to another preferred image display device according to the present invention, in the above-mentioned constitution, an exhaust hole is formed in a bottom surface portion of the room member and an exhaust pipe is connected to the exhaust hole and hence, it is possible to overcome the drawbacks of the related art.

Here, the present invention is not limited to the above-mentioned respective constitutions and constitutions which are described in embodiments explained later, and various modifications can be made without departing from the technical concept of the present invention.

According to the present invention, it is possible to surely prevent the occurrence of cracks in a getter room thus enhancing the degree of vacuum in an envelope. Further, due to the improvement of the degree of vacuum, it is possible to suppress the degradation of the display characteristic and hence, a lifetime and an image quality performance are enhanced whereby it is possible to obtain an extremely excellent advantageous effect that it is possible to realize an image display device having high quality and high reliability.

BRIEF DESCRIPTION OF THE DRAWING

FIG. 12 is a flow chart showing manufacturing steps of the image display device according to the present invention;

DETAILED DESCRIPTION OF THE INVENTION

Specific embodiments of the present invention are explained in detail hereinafter in conjunction with drawings which show the embodiments.

EMBODIMENT 1

Figure 1:
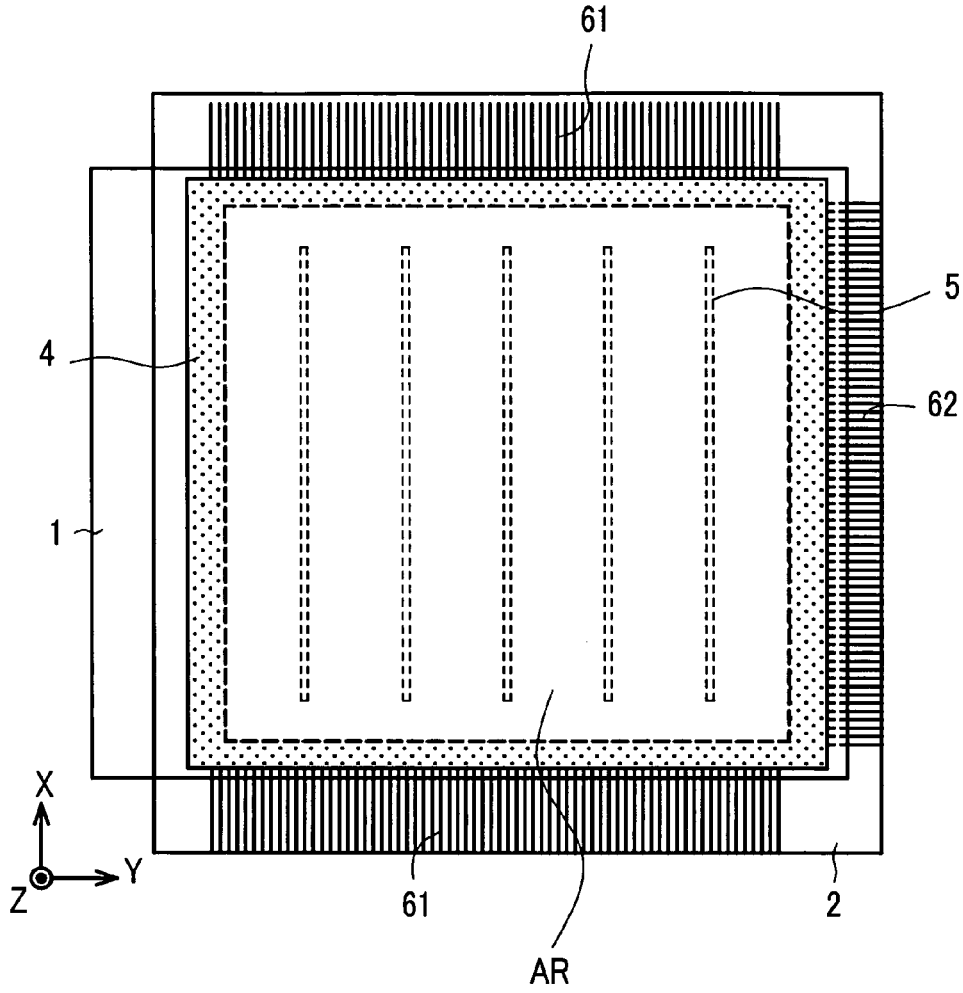
FIG. 1 is a schematic plan view showing the constitution according to an embodiment 1 of an image display device according to the present invention.
Figure 2:
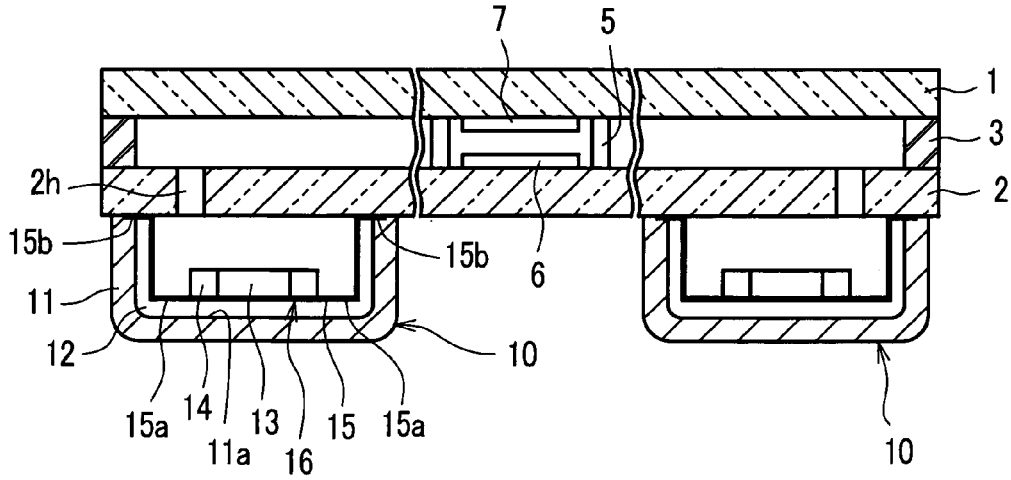
FIG. 2 is an enlarged cross-sectional view of an essential part showing the constitution of the image display device shown in FIG. 1.

FIG. 1 is a plan view of an essential part for explaining the schematic constitution of an electron-emission-type image display device according to an embodiment 1 of an image display device of the present invention, and FIG. 2 is an enlarged cross-sectional view of an essential part shown in FIG. 1. In FIG. 1 and FIG. 2, numeral 1 indicates a face substrate which is made of a light-transmitting glass plate material, and numeral 2 indicates a back substrate which is made of light-transmitting glass in the same manner as the face substrate 1 or a ceramics plate material such as alumina, wherein these face substrate 1 and back substrate 2 are formed of an insulation substrate having a plate thickness of approximately 3 mm, for example.

Further, numeral 3 indicates a frame which is formed by cutting a formed body made of glass or a frit glass plate material, assembling cut members into a frame shape, and fixing the cut members by adhesion and which functions as a support body also having a function of an outer frame. The support frame 3 is fixed by adhesion to a peripheral portion defined between the face substrate 1 and the back substrate 2 using a sealing material 4 such as frit glass. The support frame 3 is provided for holding a distance between the face substrate 1 and the back substrate 2 at a given size, for example, approximately 3 mm.

Further, numeral 5 indicates plate-like spacers for holding the distance between the face substrate 1 and the back substrate 2 at a given size. The spacers 5 are formed by cutting a thin glass plate or a ceramics plate material made of alumina or the like having a thickness of approximately 0.1 mm or less, for example, into the spacers 5 having a height of approximately 3 mm and a length of approximately 100 mm. In the inside of the display region AR shown in FIG. 1, a plurality of spacers 5 extend in one direction (x direction) in a substantially vertically erected state on the substrate surface and are arranged in parallel in another direction (y direction), and are arranged in a fixed manner by a fixing material such as frit glass. The spacers 5 hold the distance between the face substrate 1 and the back substrate 2 at a given size in corporation with the support frame 3.

Further, numeral 6 indicates a group of electron emission elements, wherein the group of electron emission elements 6 is constituted of a plurality of electron emission sources. The electron emission source is constituted of a cathode, a control electrode and the like, wherein a large number of electron emission sources are arranged above the back substrate 2 at a given interval. The cathodes are connected with cathode lines, while a plurality of cathode lines extend in one direction (y direction) and are arranged in parallel in another direction (x direction) on an inner surface of the back substrate 2. End portions of the cathode lines are pulled out to the outside of a hermetic sealing portion along two sides of the back substrate 2 as cathode-line lead lines 62.

These cathode lines (image date lines) are formed, for example, by a vapor deposition method or the like, or by a method in which a silver paste is formed by mixing a low-melting-point glass which exhibits the insulation property into conductive silver particles having a particle size of approximately 1 to 5 μm, for example, a thick film is formed by printing the silver paste, and the film is baked at a temperature of approximately 600° C.

Further, the control electrodes are connected with scanning lines, while the scanning lines are arranged above the cathode lines in a state that the scanning lines are electrically insulated from the cathode lines. End portions of the scanning lines are pulled out to the outside of the hermetic sealing portion along another one side of the back substrate 2 as scanning-line lead lines 62.

Further, the electron emission elements which are arranged at a given interval on the back substrate 2 are formed of metal-insulator-metal (MIM) type electron emission elements, electron emission structure (also referred to as surface conductive type electron source) elements which make use of an electron emission phenomenon attributed to a quantum tunneling effect, a diamond film, a graphite film, carbon nanotubes or the like.

Further, numeral 7 indicates image forming members, wherein the image forming member 7 is formed of a black matrix (BM) film, a phosphor film, a metal back film which is applied to the phosphor film and the like. The image forming member 7 is configured to be arranged on an inner surface of the face substrate 1 in a state that the image forming member 7 faces the group of electron emission elements 6 on the back substrate 2.

Further, numeral 10 indicates a getter device which is arranged on a back surface (outer surface) side of the back substrate 2. The getter device 10 is formed in a hermetically sealed manner by allowing the getter device 10 to be communicated with a through hole **2*h* formed in a portion of the back substrate 2 except for the group of electron emission elements 6. Accordingly, the inside of the getter device 10 has a degree of vacuum substantially equal to a degree of vacuum in the inside of the above-mentioned vacuum envelope. Here, the getter device 10 is configured such that a plurality of getter devices 10 are arranged when a large-sized display device panel is adopted. Although the case in which two getter devices 10 are arranged is illustrated in this embodiment, both getter devices 10 have the same structure and hence, only one getter device 10** is explained.

Figure 3:
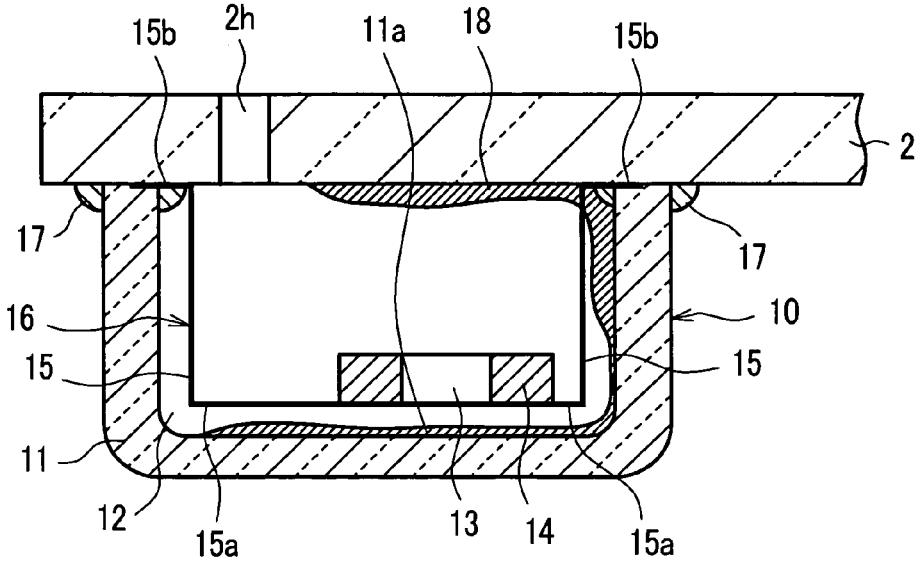
FIG. 3 is an enlarged cross-sectional view showing the constitution of a getter device shown in FIG. 2.
Figure 4:
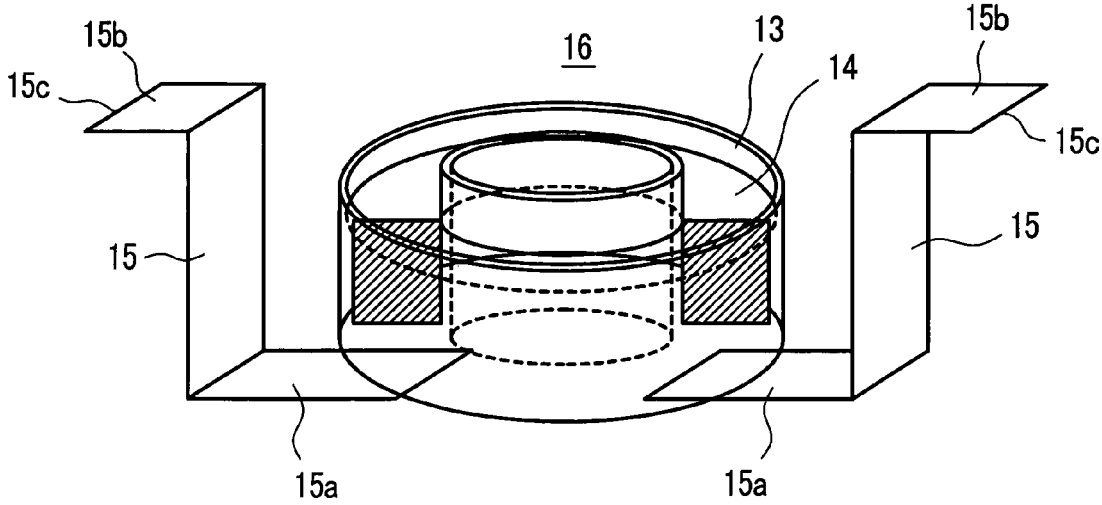
FIG. 4 is an enlarged perspective view of an essential part showing the constitution of a getter assembly shown in FIG. 2.

FIG. 3 is an enlarged cross-sectional view of an essential part showing the constitution of the getter device 10 shown in FIG. 2. As shown in FIG. 3, in the getter device 10, a getter room 12 which is held at a given degree of vacuum is formed in the inside of the cup-shaped room member 11. Sizes of the room member are set such that the size in the longitudinal direction is approximately 40 mm, the size in the lateral direction is approximately 50 mm, and the size in the height direction is approximately 5.4 mm. The room member 11 is formed as one body, and does not have joint portion. Further, in the inside of the getter room 12, a getter assembly 16 is arranged. FIG. 4 is an enlarged perspective view of the getter assembly 16. The getter assembly 16 is constituted of a getter housing 13, a getter material 14 and a getter support 15. In the inside of the getter housing 13 which is formed in a duplicate cylinder shape with one open end, the getter material (hereinafter referred to as the getter) 14 which is formed in a circular annular shape is housed and fixed. Flange portions **15*a* of a pair of getter supports 15 are fixed to a back surface of the getter housing 13** by a spot welding method, for example.

Figure 5:
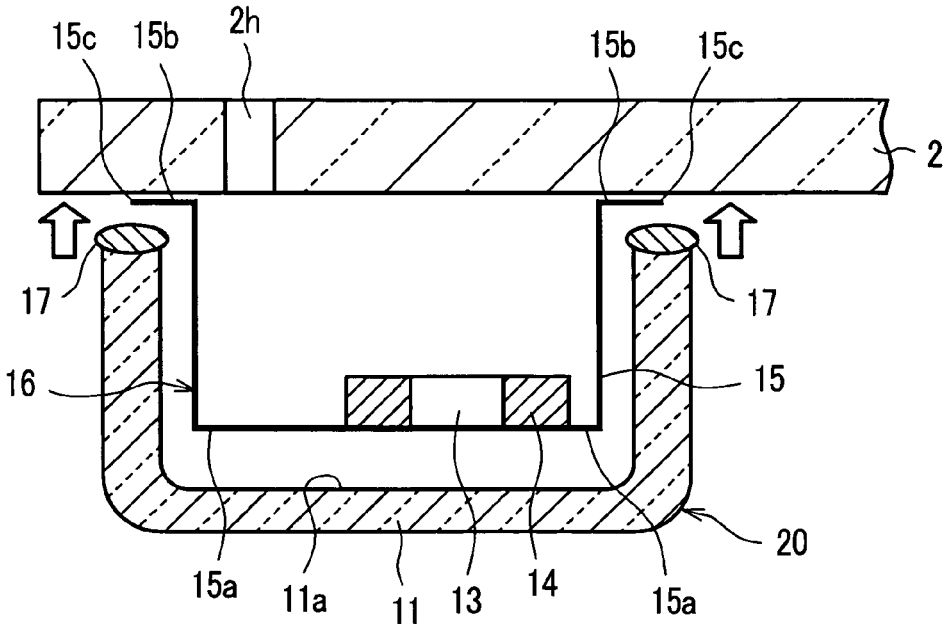
FIG. 5 is an enlarged cross-sectional view of an essential part for explaining the structure for mounting the getter assembly shown in FIG. 2 on a back substrate.

FIG. 5 is an enlarged cross-sectional view showing an assembling method of the getter assembly 16. The getter assembly 16 is brought into pressure contact with the back substrate 2 in the direction indicated by an arrow and is adhered to the back substrate 2 together with the room member 11 to which a sealing material 17 made of frit glass or the like is applied in a state that support end portions 15*c* of the support flange portions 15*b* are arranged on an opening end side. Thereafter, by applying the heat treatment to the sealing material 17, the getter assembly 16 is hermetically sealed and integrally formed on the back surface of the back substrate 2 at a given position. In the getter assembly 16, the getter housing 13 is arranged in a state that the getter housing 13 is arranged at a position spaced apart from a bottom surface of the room member 11 by approximately 0.5 mm or more thus preventing the getter housing 13 and the room member 11 from coming into contact with each other, wherein the getter assembly 16 is supported and fixed to a back surface side of the back substrate 2. The getter housing 13 which accommodates the getter 14 is, in the inside of the room member 11, configured to be arranged at a corner portion of a bottom surface portion in the inside of the room member 11 which faces a through hole 2*h* formed in the back substrate 2 in the oblique direction which has a long linear distance.

Further, the getter support 15 which supports the getter housing 13 accommodating the getter 14 is fixed by the sealing material 17 and is arranged at a given position such that the support end portions 15*c* of the respective support flange portions 15*b* do not project to the outside from the opening end of the room member 11. That is, the support end portions 15*c* of the respective support flange portion 15*b* are positioned between portions of the room material 11 and the back substrate 2 which face each other.

The panel is sealed after evacuating the gas inside the panel. After sealing, the getter 14 is heated by high frequency heating from the outside of the getter room so as to apply the getter to an inner wall of the getter room and the back substrate by vapor deposition. With respect to an inner surface of the room member 11, as shown in FIG. 3, on the inner surface positioned close to the getter 14 and on a portion of the back surface of the back substrate 2, a getter film 18 attributed to the getter flash of the getter 14 is formed.

Here, the room member 11 which constitutes the getter device 10 is formed of a molded body which is formed by molding an insulation material such as glass into a cup shape. The getter housing 13 which accommodates the getter 14 and the pair of getter supports 15 which support the getter housing 13 are formed by a press molded product of a stainless steal plate (SUS 304) for example. Further, an evaporation-type getter is used as the getter 14 and the getter 14 may be formed by combining an evaporation type getter and a non-evaluation type getter.

In the getter device 10 having such a constitution, the getter housing 13 which accommodates the getter 14 is formed of a stainless steel plate and hence, there may be a case that a thermal expansion coefficient of the getter housing 13 is larger than a thermal expansion coefficient of the room member 11 which is made of glass. However, the getter housing 13 is not integrally formed with the room member 11 and is arranged with a distance of approximately 0.5 mm or more between the getter housing 13 and the room member 11 thus preventing the direct adhesion whereby there is no possibility that the room member 11 is damaged or broken attributed to the difference in the linear thermal expansion coefficient.

Further, the flange portions 15*b* of the getter support 15 are formed of a molded product of stainless steel plate and are arranged in a spaced-apart manner from the getter housing 13 whose temperature is elevated and hence, a heat expansion amount of the flange portions 15*b* is small. Accordingly, cracks are not generated in the room member 11. Further, the room member 11 is formed by molding in a cup shape using an insulation material such as glass and hence, it is possible to form the getter room 12 by a single frit welding step. Accordingly, manufacturing steps of the display device can be simplified. Further, support end portions 15*c* of the respective support flange portions 15*b* of the pair of getter supports 15 are fixedly mounted using the sealing material 17 made of frit glass or the like and hence, the mounting position of the getter 14 becomes stable whereby the heating of the getter 14 using high frequency can be performed extremely easily.

Further, the getter 14 is arranged closer to the bottom surface portion 11*a* of the room member 11 than the back substrate 2 and hence, it is possible to form the getter film 18 in a wide range in the inside of the getter room 12. Accordingly, it is possible to largely enhance the degree of vacuum in the inside of the getter room 12 and the inside of the above-mentioned vacuum envelope. Further, the getter 14 is arranged to face the back substrate 2 in the oblique direction which ensures the long linear distance and hence, the getter film 18 formed by getter flash is adhered to the back surface of the back substrate 2 whereby it is possible to form the getter film 18 in a wide region and, at the same time, the scattering of getter in the inside of the vacuum envelope where the group of electron emission elements 6 are formed can be suppressed.

Further, the support end portions 15*c* of the getter support 15 are arranged between the back substrate 2 and the opening end of the room member 11 and hence, it is possible to simultaneously perform a frit welding step which fixes the getter assembly 16 using the sealing material 17 and a frit welding step which forms the getter room 12. Accordingly, the manufacturing steps of the image display device can be simplified. Further, it is possible to provide the structure in which the support end portions 15*c* of the respective support flange portions 15*b* of the pair of getter supports 15 are covered with the sealing material 17 and hence, the respective support end portions 15*c* are not exposed to the outside whereby it is possible to prevent the respective support end portions 15*c* from projecting to the outside from the room member 11. Accordingly, it is possible to prevent the leaking from the sealing material 17 thus maintaining the degree of vacuum.

In the image display device having such a constitution, electrons which are irradiated from the electron sources which are arranged on the respective cathode lines of the group of electron emission elements 6 formed on the back substrate 2 advance in the direction toward the image forming members 7 to which an anode voltage is applied, pass through the metal back layer (anode), and impinge on the phosphor layers so as to allow the phosphors to emit light whereby a desired display is performed on a viewing image screen. In general, a group consisting of three unit pixels of red (R), green (G), blue (B) form a color pixel.

EMBODIMENT 2

Figure 6:
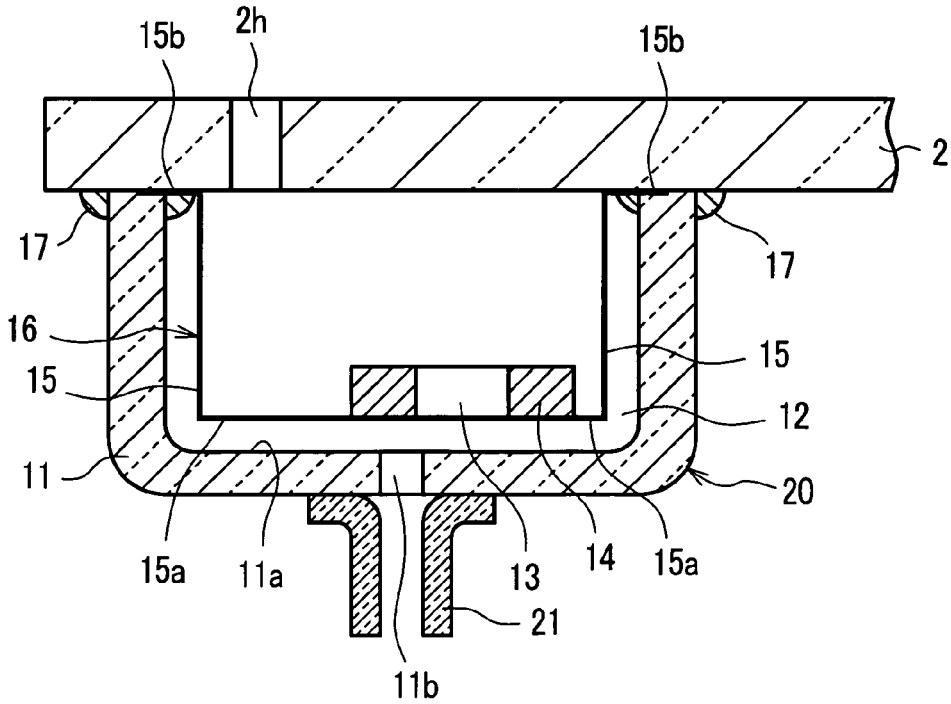
FIG. 6 is an enlarged cross-sectional view showing the constitution of the getter device according to an embodiment 2 of the image display device of the present invention.

FIG. 6 is an enlarged cross-sectional view of an essential part showing the constitution of a getter device of an electron emission type image display device of an embodiment 2 of the image display device according to the present invention, wherein parts which are identical with the parts used in the above-mentioned embodiment 1 are given same symbols and their explanation is omitted. In FIG. 6, the constitution which makes this embodiment different from the embodiment shown in FIG. 3 lies in that in the getter device 20, a through hole 11*b* is formed in a bottom surface portion 11*a* of a room member 11, and an exhaust pipe 21 which discharges the gas to set the inside of the getter room 12 and the vacuum envelope to a given degree of vacuum is hermetically connected to the through hole 11*b* by bonding.

The getter device 20 having such a constitution can discharge the gas from the getter room 12 through the exhaust pipe 21 so as to perform the tip-off in addition to the above-mentioned advantageous effects. By minimizing the installation number of the through holes 2*h* which are formed in the back substrate 2, the potential of degrading the degree of vacuum by leaking can be reduced.

Figure 7:
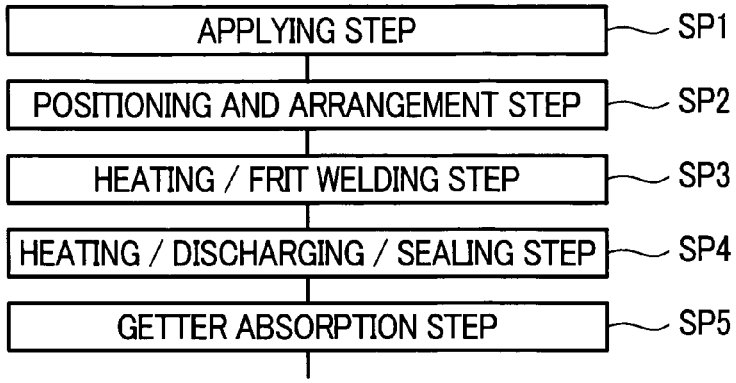
FIG. 7 is a flow chart showing manufacturing steps of the image display device according to the present invention.

FIG. 7 is a flow chart of steps for explaining a manufacturing method of the getter device which constitutes an image display device according to the present invention. As shown in FIG. 7, first of all, in step SP1, the sealing material 17 made of frit glass is applied to the opening end surfaces of the room member 11. Next in step SP2, the room member 11 and the getter assembly 16 are aligned on the back substrate 2 and, thereafter, the room member 11 and the getter assembly 16 are arranged at given positions. Next, in step SP3, the sealing material 17 is heated to approximately 380° C. so as to weld the respective members using the sealing material 17 and, thereafter, the sealing material 17 is further heated up to approximately 450° C. so that the sealing material 17 is solidified. Next, in step SP4, the gas inside the vacuum envelope is discharged so as to seal the vacuum envelope in a vacuum state. Next, in step SP5, the getter 14 is heated to a given temperature to allow the getter 14 to be scattered (getter flash) thus forming a getter film 18.

The image display device is sealed after the inside of the vacuum envelope is evacuated. The degree of vacuum in the inside of the vacuum envelope immediately after sealing is approximately $10^{-3}$ to $10^{-4}$ Pa. Thereafter, by performing the getter flash and aging, it is possible to increase the degree of vacuum to approximately $10^{-5}$ to $10^{-6}$ Pa. In the getter flash step, after sealing, the getter 14 is heated by applying the high frequency to the getter 14 from the outside of the vacuum envelope so as to evaporate the getter 14 and hence, the getter film 18 is formed on the inner wall of the getter room 12. The gas which enters the inside of the getter room 12 via the through hole 2*h* formed in the back substrate 2 is absorbed by the getter film 18 in the inside of the getter room 12. In this manner, the gas in the inside of the vacuum vessel is reduced to an extent which does not damage an image display. The getter 14 may be formed by a non-evaluation type getter.

Here, in the above-mentioned respective embodiments, the explanation has been made with respect to the case in which the room member 11 is formed in a cup shape. The present invention, however, is not limited to such a shape and the room member 11 may be formed in various shapes including a bowl shape, a dish shape and the like.

Further, in the above-mentioned respective embodiments, the explanation has been made with respect to a case in which the getter housing 13 which houses the getter 14 is supported on a pair of getter supports 15. The present invention, however, is not limited to such a case. That is, a plurality of pairs of getter supports 15 are provided and respective flange portions 15*a* of these getter supports 15 may be fixedly mounted and supported using the sealing material 17.

Figure 8:
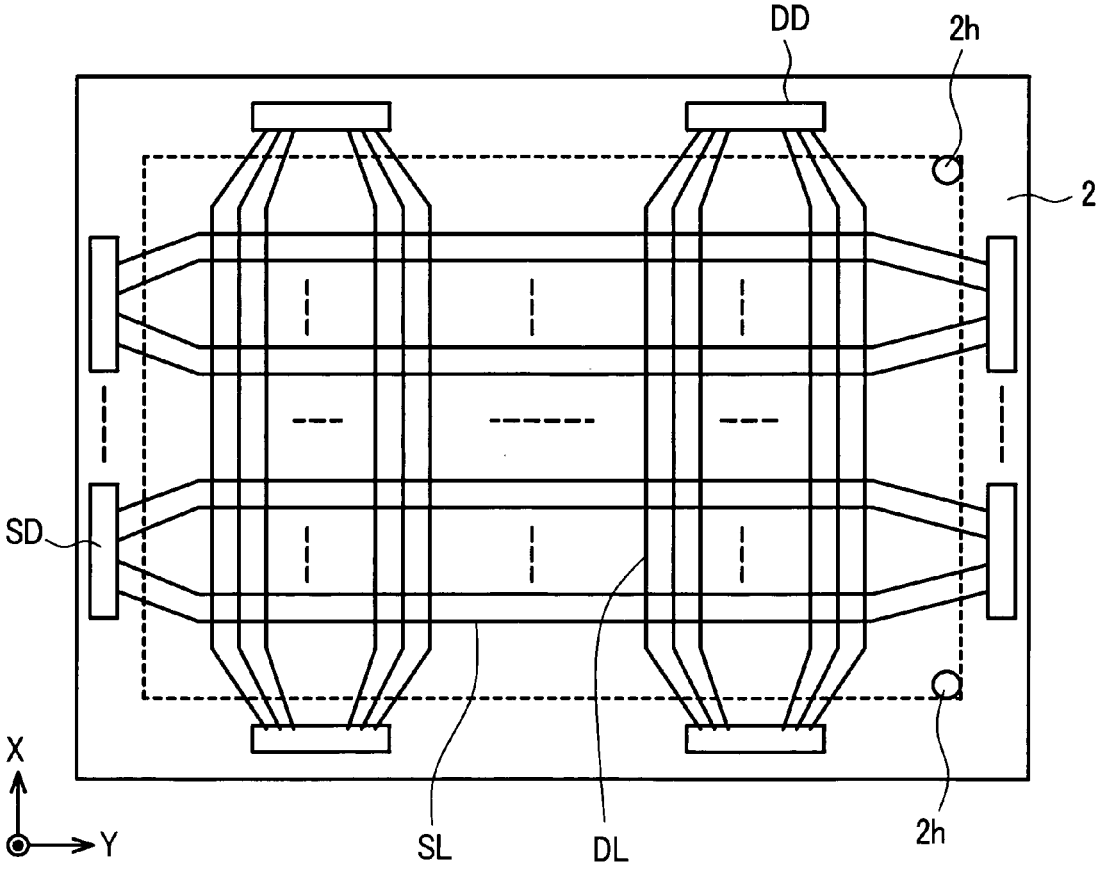
FIG. 8 is a plan view of an essential part showing the constitution of the back substrate of the image display device according to the present invention.

FIG. 8 is a plan view of an essential part as viewed from an inner surface side of the back substrate which constitutes the image display device according to the present invention. In FIG. 8, on a first surface (main surface) of the back substrate 2 which is preferably made of glass, a ceramics material or the like, a plurality of data lines (or also referred to as cathode lines) DL which extend in the first direction (y direction) and are arranged in parallel in the second direction (x direction) which intersects the first direction, and a plurality of scanning lines SL which extend in the second direction (x direction) and are arranged in parallel in the first direction (y direction) which intersects the second direction are formed. Electron emission sources are formed on intersecting portions of these data lines DL and scanning lines SL which are arranged in a matrix array or in the vicinity of the intersecting portions.

The scanning lines SL have one ends thereof connected to a scanning driver SD. On the other hand, the data lines DL have one ends thereof connected to a data driver DD. The face substrate is arranged to face the back substrate 2 in an opposed manner along a broken-line portion in the drawing. The face substrate and the back substrate 2 are adhered to each other along outer peripheries of facing regions thereof and are sealed after evacuating an inner gas. On the other hand, the above-mentioned respective getter devices are arranged on a second surface (back surface) of the back substrate 2 in a state that the respective getter devices are communicated with the inside of the vacuum envelope via through holes 2*h*.

Figure 9:
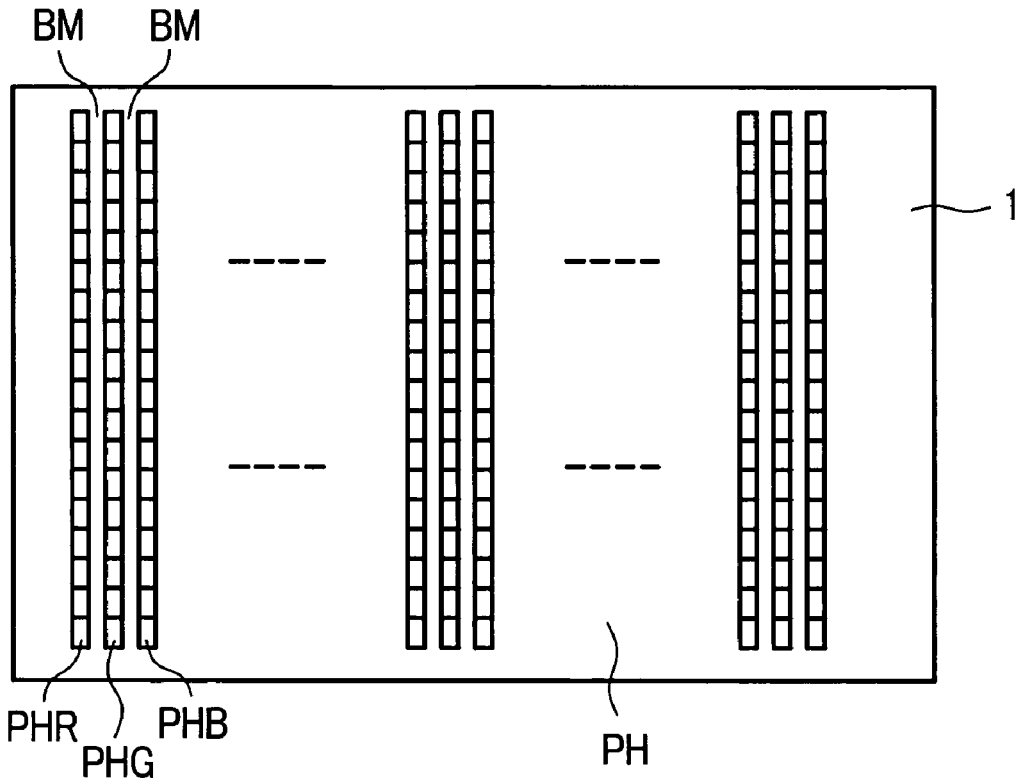
FIG. 9 is a plan view of an essential part showing the constitution of a face substrate of the image display device according to the present invention.

FIG. 9 is a plan view of an essential part as viewed from an inner surface side of the face substrate 1 which constitutes the image display device according to the present invention. In FIG. 9, on an inner surface (main surface) of the face substrate 1 made of a light-transmitting glass material, a phosphor screen PH having red phosphor layers PHR, green phosphor layers PHG, and blue phosphor layers PHB is formed along the lengthwise direction of the plurality of data lines DL shown in FIG. 8 and, at the same time, on the phosphor screen PH, a black matrix films BM which define the respective red phosphor layers PHR, the green phosphor layers PHG, and the blue phosphor layers PHB are formed.

Figure 10:
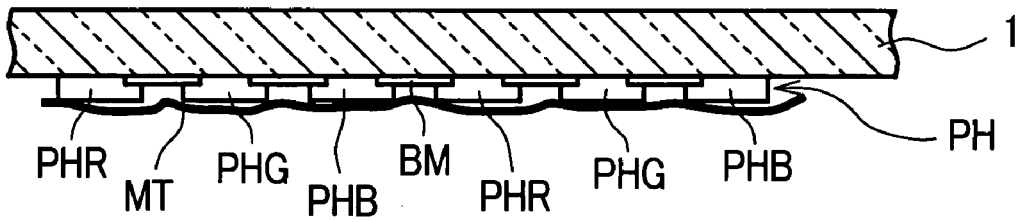
FIG. 10 is an enlarged cross-sectional view of an essential part showing the constitution of a phosphor screen which is formed on the face substrate of the image display device according to the present invention.

FIG. 10 is an enlarged cross-sectional view of the phosphor screen PH which is formed on the inner surface of the face substrate 1. In FIG. 10, the respective red phosphor layers PHR, the green phosphor layers PHG, and the blue phosphor layers PHB which constitute the phosphor screen PH are formed to cover portions of the black matrix films BM. Further, on the phosphor screen PH, a metal back film MT which efficiently reflects the emitted lights of the respective red phosphor layers PHR, the green phosphor layers PHG and the blue phosphor layers PHB is formed.

Further, in the above-mentioned embodiments, although the explanation has been made with respect to the case in which the present invention is applied to the FED which uses the face substrate which forms the phosphors and black matrixes on the inner surface and forms the anode on the back surface of the phosphors and the black matrixes as the image display device, the present invention is not limited to such a case. That is, it is possible to obtain the exactly same advantageous effects as the above-mentioned embodiments by applying the present invention to a plasma display (PDP) or a panel type display including metal-insulator-metal type electron emission sources.

The followings are other embodiments.

An image display device according to the present invention includes a vacuum envelope in which a back substrate which forms a plurality of electron emission sources thereon and a face substrate which forms an anode and phosphors on an inner surface thereof which faces an electron emission source forming surface of the back substrate are arranged to face each other with a given distance therebetween, and a space defined between the back substrate and the face substrate is hermetically sealed. To a back surface of the back substrate, a getter room which is communicated with the vacuum envelope is provided. A room member which constitutes the getter room is hermetically bonded to the vacuum envelope by way of a sealing material and a getter assembly is arranged in the inside of the getter room. The getter assembly includes a getter, a getter housing which holds the getter, and a getter support which supports the getter housing, and a positioning rod which sets an arrangement position of the getter, and a positioning groove which allows the insertion of a distal end portion of the positioning rod therein is formed in the inside of the room member. By allowing the distal end portion of the positioning rod to be inserted into the positioning groove, it is possible to stabilize the positioning of the getter.

Accordingly, the present invention can provide an image display device which can suppress the degradation of the display characteristic by stabilizing the positioning of the getter.

Further, with respect to another preferred image display device of the present invention, in the above-mentioned constitution, a through hole is formed in the back substrate so as to allow the getter room to be communicated with the vacuum envelope via the through hole and hence, the getter room is maintained at a degree of vacuum substantially equal to a degree of vacuum of the vacuum envelope.

Further, with respect to another preferred image display device according to the present invention, in the above-mentioned constitution, by forming the room member by fixing a face plate and a frame using a sealing material and by forming the positioning groove in a sealing surface between the face plate and the frame, the positioning of the getter is stabilized and hence, it is possible to overcome the drawbacks of the related art.

Further, with respect to another preferred image display device according to the present invention, in the above-mentioned constitution, the getter assembly includes a plurality of positioning rods and the room member includes a plurality of positioning grooves corresponding to the positioning rods and hence, the positioning of the getter is stabilized whereby it is possible to overcome the drawbacks of the related art.

Further, with respect to another preferred image display device according to the present invention, in the above-mentioned constitution, by forming an exhaust port in a bottom surface portion of the room member and by connecting an exhaust pipe to the exhaust port, the evacuation of gas from the getter room becomes possible and hence, it is possible to overcome the drawbacks of the related art.

Further, with respect to another preferred image display device according to the present invention, in the above-mentioned constitution, by arranging a shielding plate which blocks the scattering of the getter in the vicinity of the through hole, the scattering of the getter material into the inside of the vacuum envelope can be prevented and hence, it is possible to overcome the drawbacks of the related art.

Here, the present invention is not limited to the above-mentioned respective constitutions and constitutions which are described in embodiments explained later, and various modifications can be made without departing from the technical concept of the present invention.

According to the present invention, by allowing the getter to be surely positioned so as to stabilize the amount of the scattering of the getter, it is possible to surely prevent the occurrence of cracks in a getter room thus enhancing the degree of the vacuum in a vacuum envelope. Further, due to the improvement of the degree of vacuum, it is possible to suppress the degradation of the display property and hence, a lifetime and an image quality performance are enhanced whereby it is possible to obtain an extremely excellent advantageous effect that an image display device having high quality and high reliability can be realized.

Figure 11:
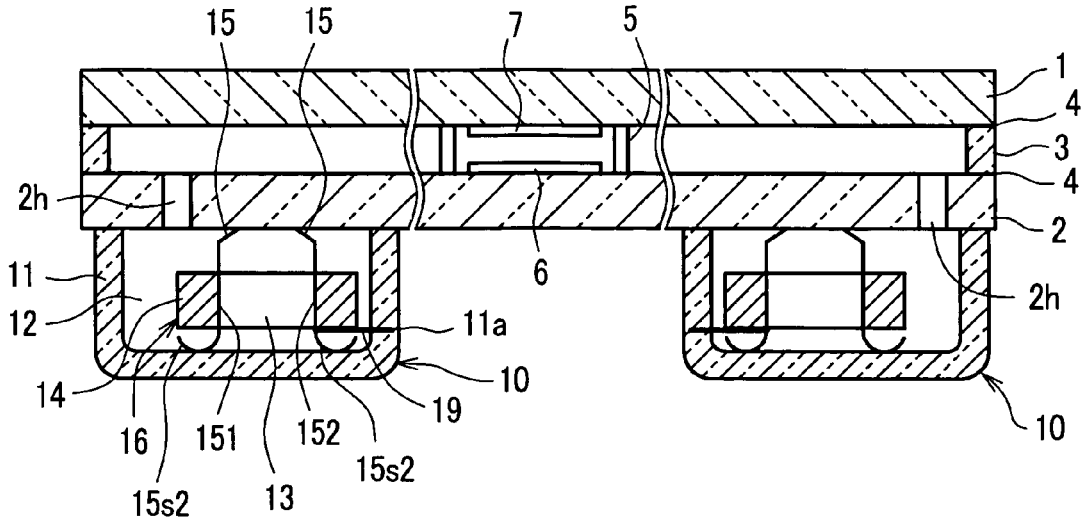
FIG. 11 is an enlarged cross-sectional view of an essential part showing the constitution of the image display device shown in FIG. 1.

FIG. 11 is an enlarged cross-sectional view of an essential part showing the constitution of the getter device of the image display device shown in an Embodiment 6. Parts of this embodiment 6 identical with the parts of the above-mentioned embodiment 1 are given the same symbols and their explanation is omitted.

In the getter device 10, a getter room 12 which is held at a given degree of vacuum substantially equal to a degree of vacuum of a vacuum envelope is formed in the inside of a room member 11 which is formed in a cup shape. In the inside of the getter room 12, a getter assembly 16 is arranged in a state that the getter assembly 16 is sandwiched between a back surface of a back substrate 2 and a room member 11 which face each other in an opposed manner.

Figure 12:
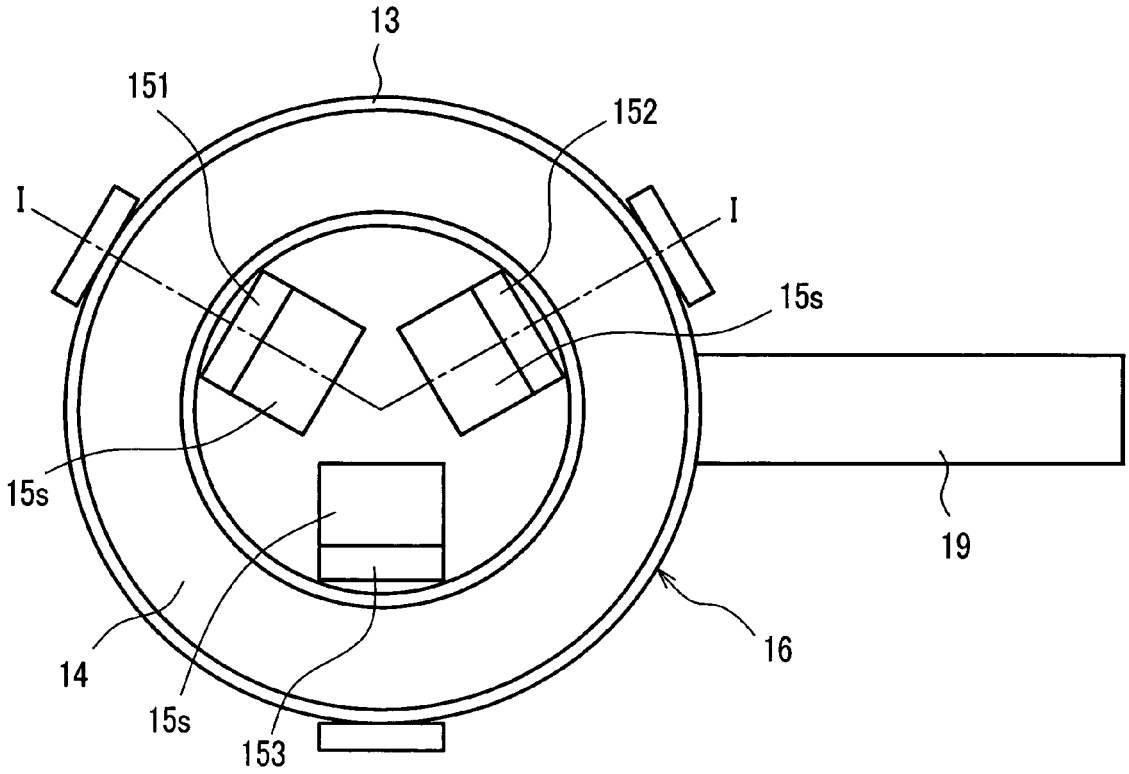
FIG. 12 is an enlarged cross-sectional view showing the constitution of a getter device shown in FIG. 11.
Figure 13:
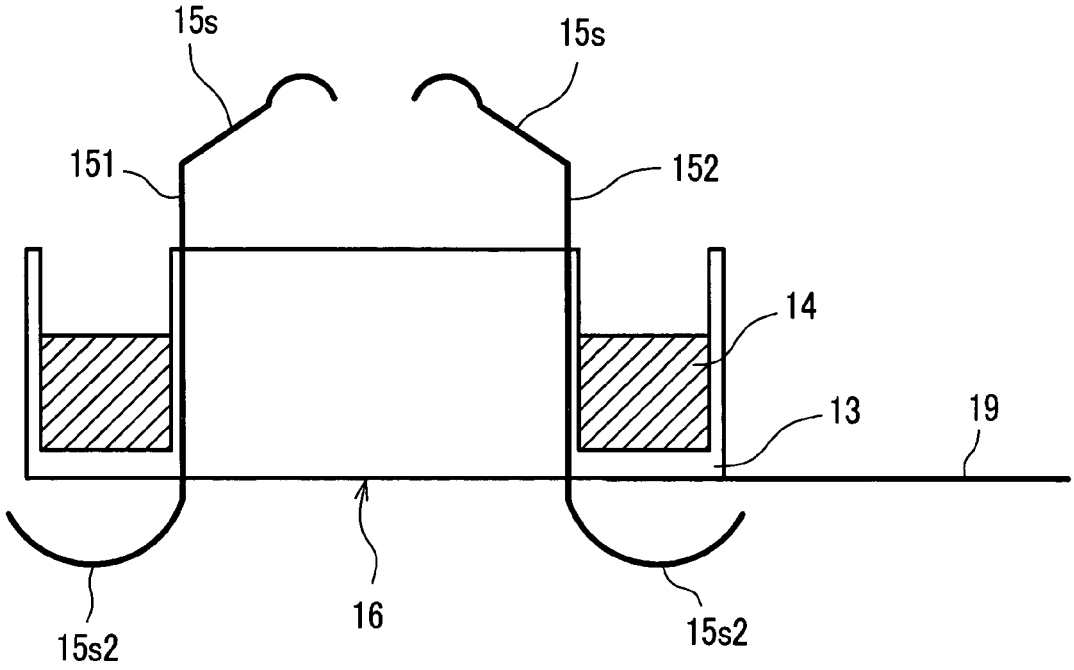
FIG. 13 is an enlarged perspective view of an essential part showing the constitution of a getter assembly shown in FIG. 11.

FIG. 12 is an enlarged plan view as viewed from above showing the getter assembly 16, and FIG. 13 is an enlarged cross-sectional view taken along a line 1-1 in FIG. 12. As shown in FIG. 12 and FIG. 13, in the getter assembly 16, a getter 14 which is formed in a circular annular shape is housed and fixed in the inside of a getter housing 13 formed in a duplicate cylindrical shape with one end thereof open-ended. The getter housing 13 is supported by getter supports 151, 152, 153 respectively which hold the getter housing 13 at three positions. Further, a getter positioning rod 19 is configured to be fixed to a back surface of the getter housing 13 by a spot welding method, for example.

Here, these getter supports 151, 152, 153 have one end sides (back-surface sides of the back substrate 2) thereof formed of a spring portion 15*s* having a curved surface, while the getter supports 151, 152, 153 have another end sides (bottom-surface sides of the room member 11) thereof formed of a spring portion 15*s*2 having a similar curved surface.

The getter assembly 16 having such a constitution is sandwiched between the back surface of the back substrate 2 and the bottom surface of the room member 11 in a state that the respective pairs of spring portions 15*s*, 15*s*2 which are formed on both end portions of the getter supports 151, 152, 153 are brought into contact with the back surface of the back substrate 2 and the bottom surface of the room member 11. The back surface of the back substrate 2 and an opening end of the room member 11 are hermetically sealed by way of sealing materials 17 represented by frit grass, for example. Due to such a constitution, the occurrence of cracks in the back substrate 2 and the room member 11 can be suppressed.

Figure 14:
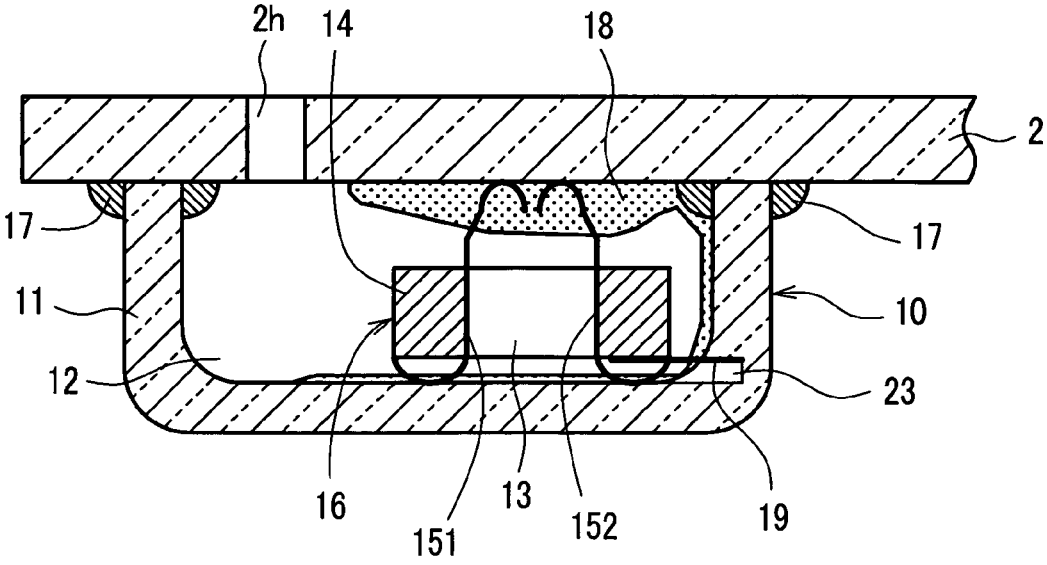
FIG. 14 is an enlarged cross-sectional view of an essential part for explaining the structure for mounting the getter assembly in FIG. 11 on a back substrate.

In a portion of an inner wall surface of the room member 11, a positioning groove 23 is formed by an etching method, a grinding method or the like, for example. Further, in the getter assembly 16 having such a constitution, as shown in FIG. 14 which is an enlarged cross-sectional view of an essential part, by inserting a distal end portion of the positioning rod 19 of the getter assembly 16 into the inside of the positioning groove 23, the getter assembly 16 is positioned and hence, a mounting position of the getter 14 is determined.

Accordingly, the getter assembly 16 has the position thereof in the panel thickness direction determined by the resilient characteristics of the respective pairs of spring portions 15*s*, 15*s*2 of the getter supports 151, 152, 153 and has the position thereof in the planar direction determined by the positioning rod 19. Accordingly, the mounting and fixing of the getter device 10 in the inside of the getter room 12 can be facilitated and hence, the image display device can be extremely easily manufactured.

Further, the getter assembly 16 having such a constitution is arranged in a state that the opening end of the getter housing 13 faces the back surface of the back substrate 2. A film thickness of a getter film 18 formed on the back surface of the back substrate 2 after getter flashing is set larger than a film thickness of the getter film 18 on an inner surface of the room member 11.

Here, although the explanation has been made with respect to the case in which the shape of the room member 11 is formed in a cup shape in the embodiment 6, in the present invention, the shape of the room member 11 is not limited to such a shape and may be formed in various kinks of shapes including a bowl shape and a dish shape.

Figure 15:
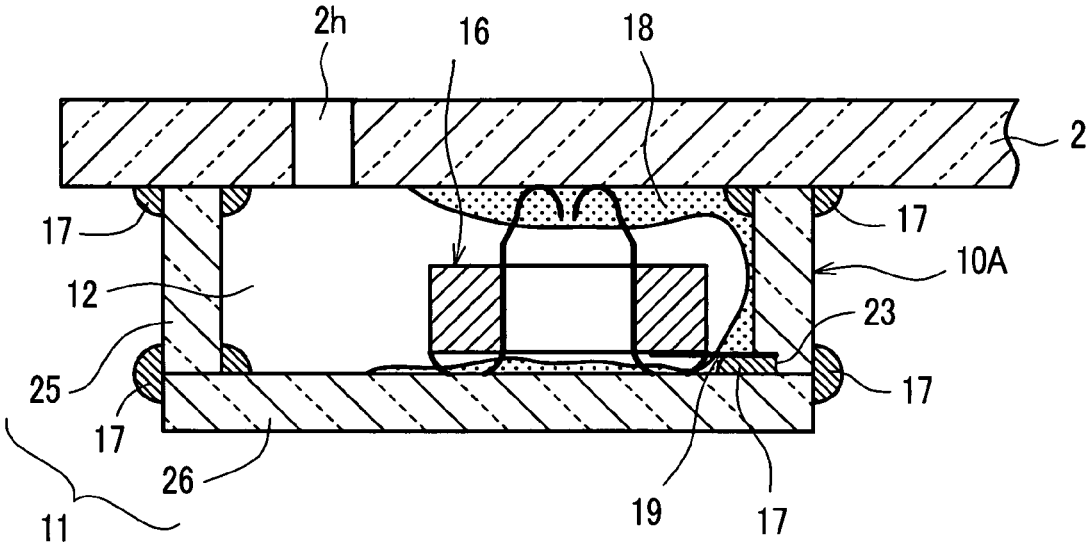
FIG. 15 is an enlarged cross-sectional view showing the constitution of a getter device of an embodiment 7 of the image display device according to the present invention.
Figure 16:
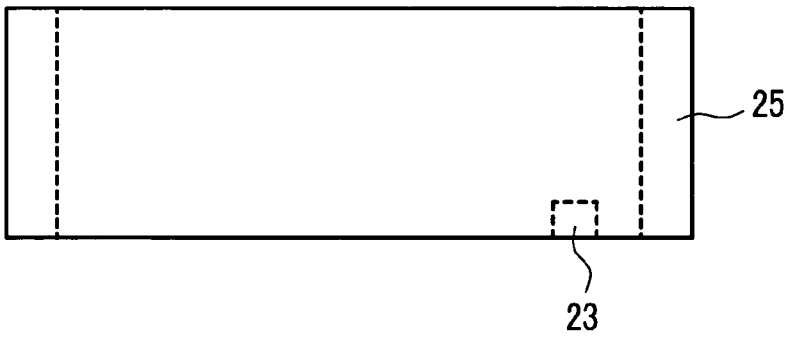
FIG. 16 is a plan view as viewed from a side surface of a frame shown in FIG. 15.
Figure 17:
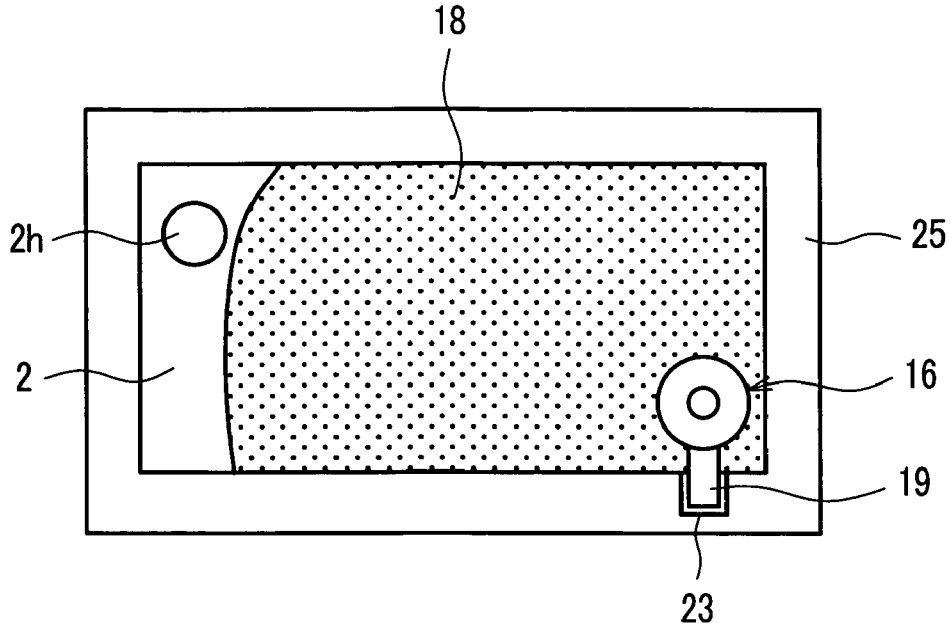
FIG. 17 is a plan view of an upper surface in the inside of a getter room in FIG. 15.

FIG. 15 is an enlarged cross-sectional view of an essential part of a getter device according to an embodiment 7 of the image display device according to the present invention. FIG. 16 is a plan view as viewed from a side surface of a frame shown in FIG. 15, and FIG. 17 is a plan view of an upper surface in the inside of a getter room shown in FIG. 15, wherein parts which are identical with the parts described in the above-mentioned drawings are given the same symbols and their explanation is omitted.

In FIG. 15, the constitution which makes this embodiment different from the embodiment shown in FIG. 14 lie in that to a back surface of the back substrate 2 in which a through hole 2*h* is formed, a frame 25 which is formed of a rectangular glass plate material and a face plate 26 which is formed of a glass plate material are fixed using a sealing material 17 made of frit glass or the like thus constituting a getter room member 11.

Further, a recessed positioning groove 23 is integrally formed in a sealing surface between the frame 25 and the face plate 26, wherein a distal end portion of the positioning rod 19 of a getter assembly 16 which is sandwiched in the inside of the getter room member 11 is inserted into the positioning groove 23. The distal end portion of the positioning rod 19 is fixed by the sealing material 17 made of frit glass or the like in the inside of the positioning groove 23 thus constituting a getter device 10A.

The getter assembly 16 has the distal end portion of the positioning rod 19 thereof supported and fixed using the sealing material 17 and hence, the movement or the displacement of the getter assembly 16 attributed to external vibrations can be suppressed. Further, it is possible to simultaneously perform a sealing member melting step which fixes the getter assembly 16 and a sealing member melting step which forms the getter room 12 and hence, manufacturing steps of the image display device can be simplified. Further, the embodiment adopts the structure in which the distal end portion of the positioning rod 19 is housed and fixed in the inside of the positioning groove 23 and hence, there exists no possibility that the distal end portion of the positioning rod 19 projects to the outside of the getter room 12. Accordingly, it is possible to suppress the lowering of the degree of vacuum in the inside of the getter room 12.

The getter assembly 16 is sandwiched between the face plate 26 and the back surface of the back substrate 2 due to the resilient characteristics of the respective pairs of spring portions 15*s*, 15*s*2 of getter supports 151, 152, 153. Since the getter assembly 16 is supported and fixed using only one positioning groove 23, the deformation and the displacement of various constitutional members at the time of heating the getter 14 or the like can be surely prevented.

Figure 18:
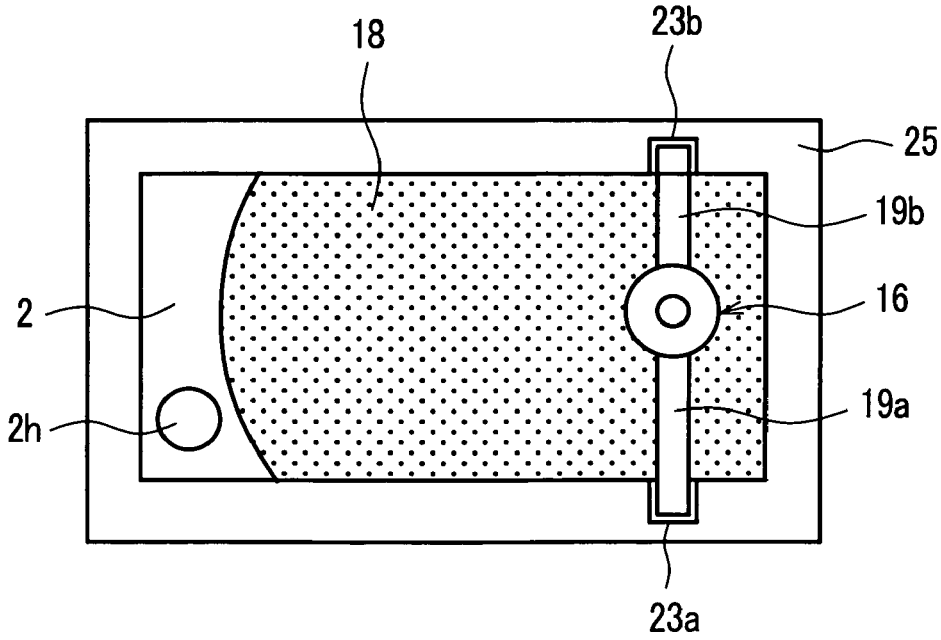
FIG. 18 is a plan view of an upper surface in a getter room which shows the constitution according to another embodiment of the getter device.

FIG. 18 is a plan view of an upper surface in the inside of a getter room of another embodiment of the getter device according to the present invention, wherein parts identical with the parts described in the above-mentioned drawings are given same symbols and their explanation is omitted.

In FIG. 18, in a getter assembly 16, a pair of positioning rods 19*a*, 19*b* is integrally formed on a back surface of a getter housing in symmetry. Further, positioning grooves 23*a*, 23*b* are respectively formed in a frame 25 at given positions so as to allow the insertion of distal end portions of these pair of positioning rods 19*a*, 19*b*.

Due to such a constitution, the getter assembly 16 is supported on and fixed to the frame 25 in a state that the getter assembly 16 is positioned in a stable manner and hence, the positioning of the getter 14 can be performed more reliably and, at the same time, it is possible to fix and arrange the getter assembly 16 at a position where the getter film 18 does not invade the inside of the through hole 2*h*.

Figure 19:
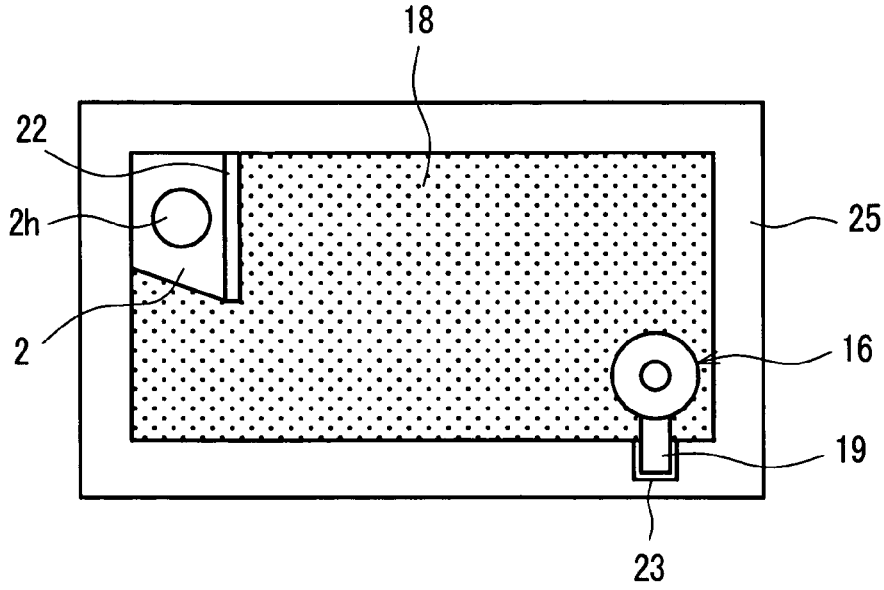
FIG. 19 is a plan view of an upper surface in a getter room which shows the constitution according to still another embodiment of the getter device.

FIG. 19 is a plan view of an upper surface in the inside of a getter room of still another embodiment of the getter device according to the present invention, wherein parts identical with the parts described in the above-mentioned drawings are given same symbols and their explanation is omitted. In FIG. 19, in the vicinity of a through hole 2*h* which is formed in a back substrate 2, a shielding plate 22 formed of a glass plate member which blocks the intrusion of a getter material scattered from a getter in the inside of a getter assembly 16 into the inside of a vacuum envelope is arranged in a state that the shielding plate 22 is fixedly secured to a back surface of the back substrate 2 using a sealing material.

Further, in such a constitution, by arranging the shielding plate 22 between the through hole 2*h* formed in the back substrate 2 and the getter assembly 16, a getter film 18 does not reach the through hole 2*h*. By forming a shape of a getter room 12 in a quadrangular shape, it is possible to mount the getter assembly 16 at a position diagonal to the through hole 2*h*. Further, it is possible to ensure a large distance between the getter assembly 16 and the through hole 2*h*. Due to such a constitution, it is possible to block the intrusion of the scattered getter material into the vacuum envelope (the inside of a panel) and hence, the deterioration of spark and emission in the inside of the panel is hardly generated.

Figure 20:
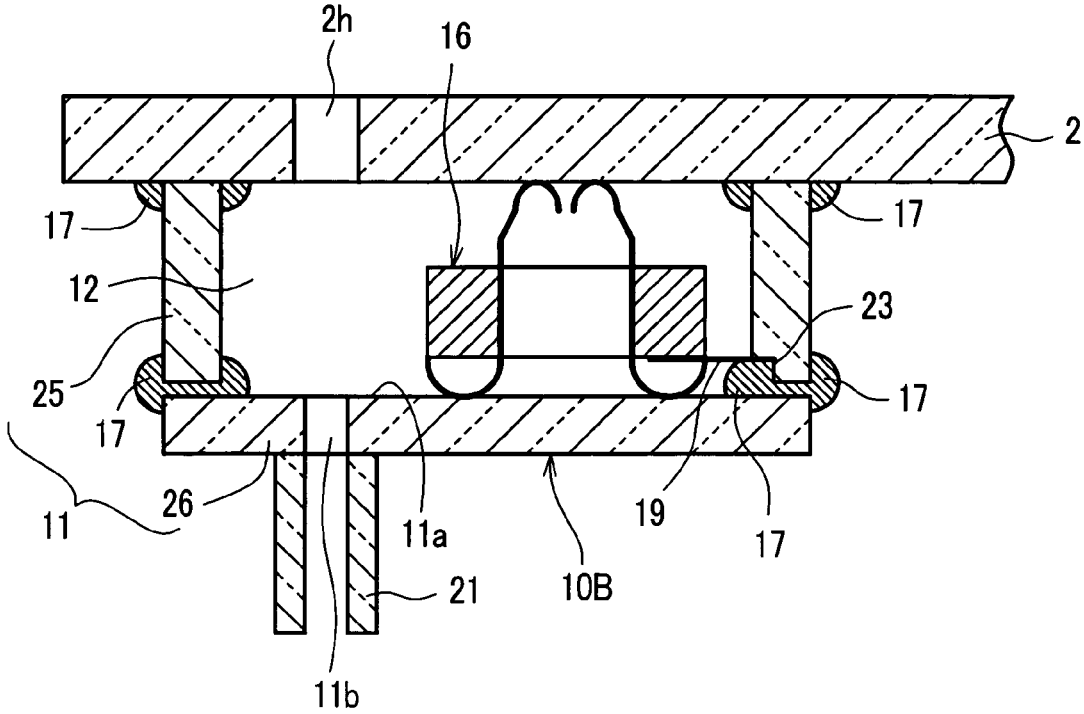
FIG. 20 is an enlarged cross-sectional view showing the constitution of the getter device of an embodiment 8 of the image display device according to the present invention.

FIG. 20 is an enlarged cross-sectional view showing a getter device of an electron emission type display device of an embodiment 8, wherein parts identical with the parts used in the above-mentioned embodiment 1 are given the same symbols and their explanation is omitted. In FIG. 20, in a getter device 10B, a through hole 11*b* is formed in a bottom surface portion 11*a* of a room member 11, that is, a face plate 21, and an exhaust pipe 23 which evacuates the inside of a getter room 12 and the inside of a vacuum envelope to a given degree of vacuum is connected to the through hole 11*b* in a hermetically bonded manner.

In the getter device 10B having such a constitution, in addition to advantageous effects similar to the above-mentioned advantageous effects, the inside of the vacuum envelope can be evacuated through the getter room 12 using the exhaust pipe 23 thus performing the tip-off. Accordingly, it is possible to minimize a mounting amount of the through hole 2*h* formed in the back substrate 2. Further, it is possible to reduce a potential of the deterioration of degree of vacuum attributed to leaking.

Here, in the above-mentioned respective embodiments, the room member 11 which constitutes the getter device 10, 10A, 10B is formed of an insulating member made of glass or the like, and the getter housing 13 which houses the getter 14, the pairs of getter supports 151, 152, 153 which support the getter housing 13, the getter positioning rods 19, 19*a*, 19*b* and the like are formed of a press molded product made of stainless steel plate (SUS 304), for example. Further, a Ba volatile getter is used as the getter 14 and the getter 14 may be used in combination with a non-volatile getter.

Figure 21:
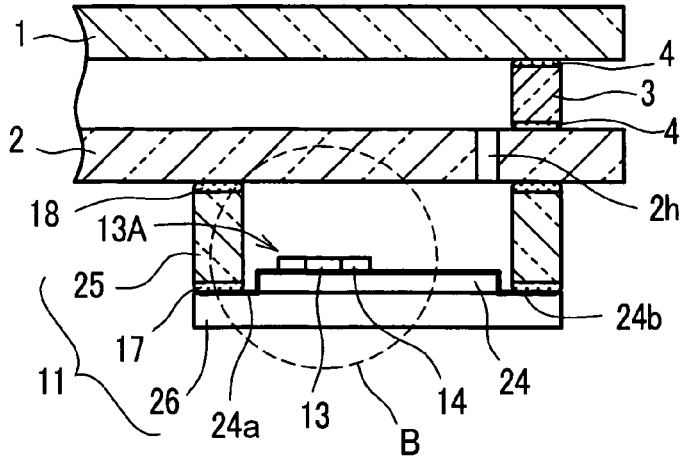
FIG. 21 is an enlarged cross-sectional view showing the constitution of a getter device of an embodiment 9 of the image display device according to the present invention.
Figure 22:
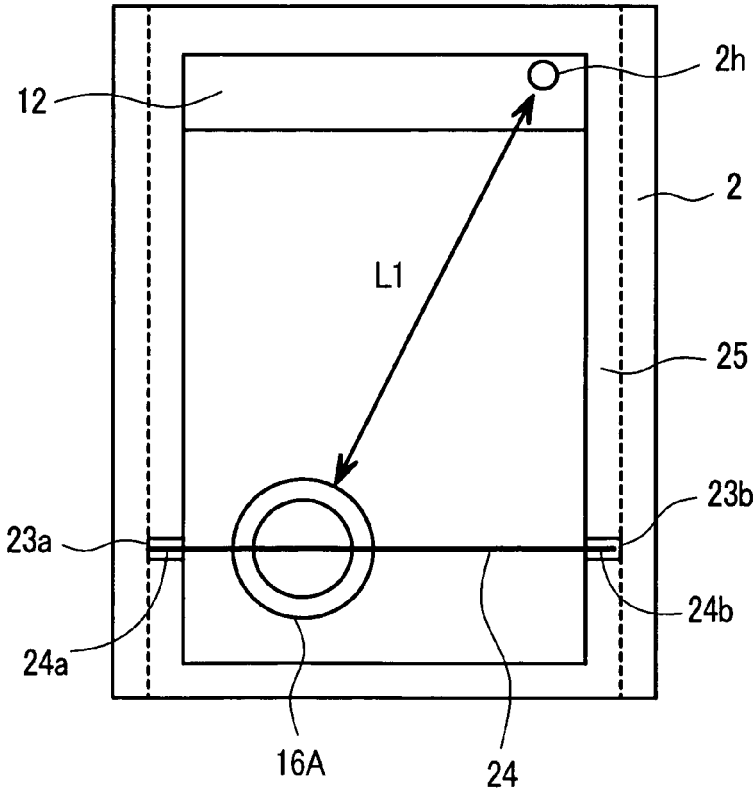
FIG. 22 is a plan view of an essential part of the inside of the getter device shown in FIG. 21.

FIG. 21 is an enlarged cross-sectional view of an essential part showing the constitution of getter device of an electron emission type display device according to an embodiment 9 of an image display device, and FIG. 22 is a plan view of an essential part of the inside of the getter device, wherein parts identical with the parts of the above-mentioned embodiments are given the same symbols and their explanation is omitted. In FIG. 21 and FIG. 22, in the getter assembly 16A, a getter 14 which is formed in a circular annular shape is housed and fixed in the inside of a getter housing 13 formed in a duplicate cylindrical shape with one end thereof open-ended. To a back surface of the getter housing 13, a rod-like getter support 24 is fixed by a spot welding method, for example. The rod-like getter support 24 has both functions of holding and positioning the getter assembly 16A.

In the getter assembly 16A having such a constitution, flange portions 24*a*, 24*b* formed on both end sides of the getter support 24 are inserted into the inside of the respective positioning grooves 23*a*, 23*b* which are formed in a sealing surface of a frame 23 as shown in FIG. 22. Further, the flange portions 24*a*, 24*b* are fixedly secured between the sealing surfaces of the frame 25 and a face plate 21 using a sealing material 17. The getter assembly 16A is arranged at a position spaced apart from a through hole 2*h* formed in a back substrate 2 by a distance L1 in a state that the getter assembly 16A is supported on and fixed to the back substrate 2. That is, the getter assembly 16A and the through hole 2*h* assume the diagonal arrangement in the inside of the getter room 12.

Figure 23:
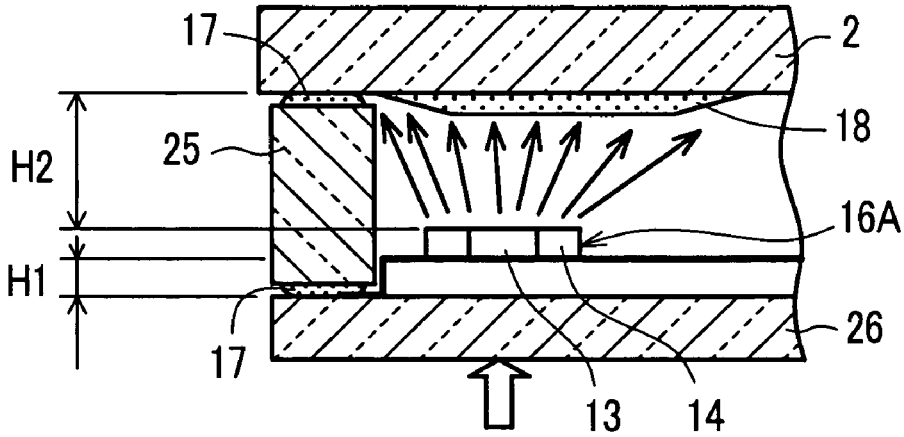
FIG. 23 is an enlarged cross-sectional view of a portion B in FIG. 21.

FIG. 23 is an enlarged cross-sectional view of a portion B in FIG. 21 for explaining a mounting height of the getter assembly 16A. A distance (space) H1 between the getter 14 and an inner surface of a face plate 26 is set to a distance which prevents the getter housing 13 from coming into contact with the face plate 26 at the time of heating the getter housing 13. That is, the distance H1 is set to approximately 0.5 mm or more. Further, with respect to a flash surface side of the getter 14, a distance between the getter 14 and a back surface of the back substrate 2 is set to a distance which allows the scattering of a getter material. That is, a space H2 which allows the scattering of the getter material after heating the getter 14 is set to approximately 1 mm or more.

Figure 24:
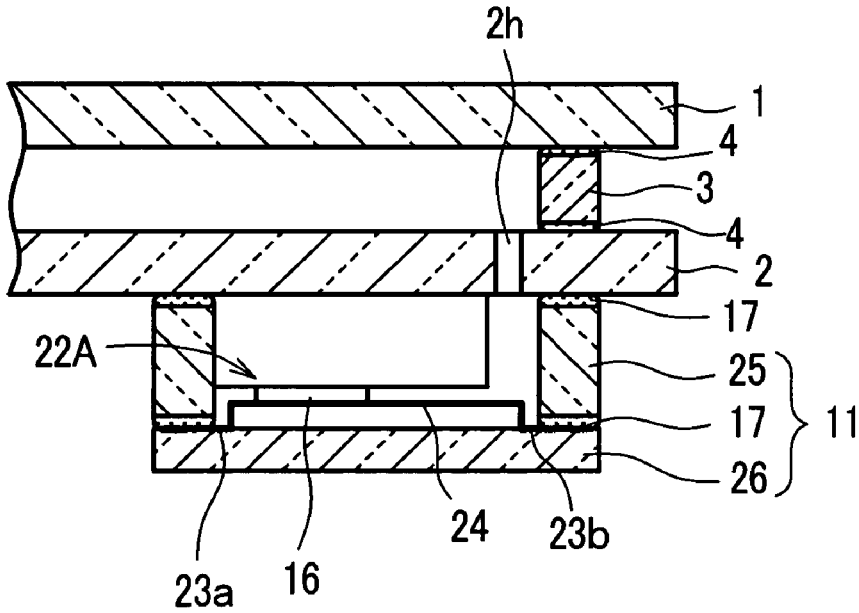
FIG. 24 is an enlarged cross-sectional view showing the constitution of a getter device of an embodiment 10 of the image display device according to the present invention.
Figure 25:
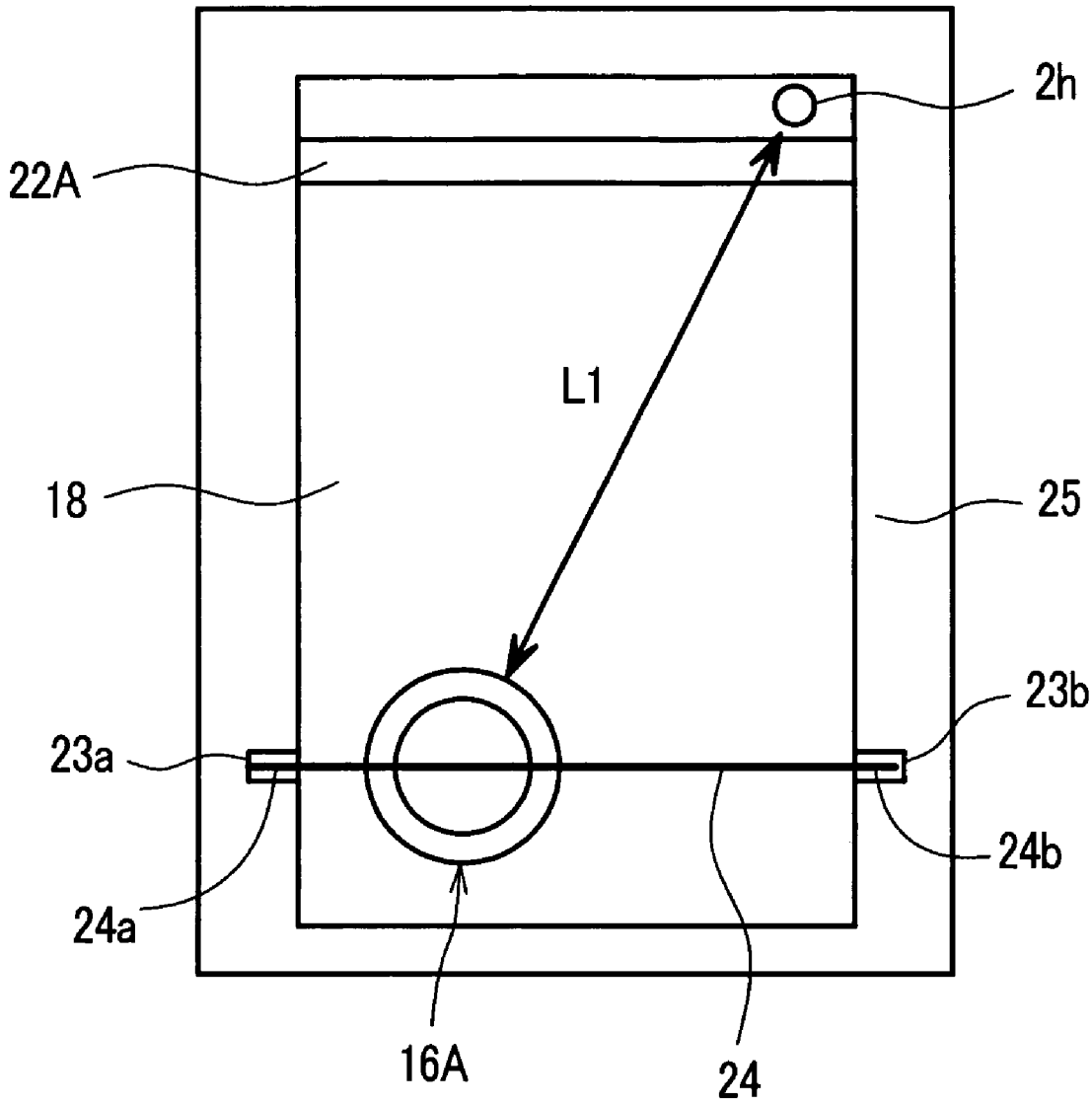
FIG. 25 is a plan view of an essential part of the inside of the getter device shown in FIG. 24.

FIG. 24 is an enlarged cross-sectional view of an essential part showing the constitution of getter device of an electron emission type display device according to an embodiment 10, and FIG. 25 is a plan view of an essential part of the inside of the getter device, wherein parts identical with the parts described in the above-mentioned embodiments are given the same symbols and their explanation is omitted. In FIG. 24 and FIG. 25, in the vicinity of a through hole 2*h* which is formed in a back substrate 2, a shielding plate 22A formed of a glass plate member is arranged in a state that the shielding plate 22A surrounds a substantially whole surface of a peripheral portion of the through hole 2*h*. The shielding plate 22A is fixed to a back surface of the back substrate 2. Here, a height of the shielding plate 22A is set lower than a height of a frame 25.

By arranging the shielding plate 22 in a state that the shielding plate 22A substantially surrounds the whole surface of the peripheral portion of the through hole 2*h* formed in the back substrate 2, it is possible to mount a getter assembly 16A at a position diagonal to the through hole 2*h* and, at the same time, it is possible to take a larger distance between the getter assembly 16A and the through hole 2*h*. Due to such a constitution, the intrusion of the scattered getter material into a vacuum envelope (the inside of a panel) can be surely blocked and hence, the deterioration of spark and emission in the inside of the panel can be further hardly generated.

What is claimed is:

1. An image display device including a vacuum envelope in which a back substrate which forms electron emission sources thereon and a face substrate which forms an anode and phosphor layers thereon are arranged to face each other, wherein a room member for forming a getter room which is communicated with the vacuum envelope is bonded to a back surface of the back substrate by way of a sealing material, wherein a getter assembly is arranged in the inside of a getter room, wherein the getter assembly includes a getter material, a getter housing which holds the getter material, and a getter support, wherein the getter housing is arranged in the inside of the getter room in a state that the getter housing is supported on the getter support, and wherein the getter support is fixed between the back substrate and the room member by way of the sealing material, wherein an end portion of the getter support is arranged between the back substrate and the room member by way of the sealing material, and wherein the getter support includes a flange portion and the flange portion is fixedly mounted on the getter housing by way of a sealing material.

2. An image display device according to claim 1, wherein a through hole is formed in the back substrate and the getter room is communicated with the vacuum envelope via the through hole.

3. An image display device according to claim 1, wherein the getter is arranged in the vicinity of a bottom surface portion of the room member.

4. An image display device according to claim 1, wherein the housing is arranged in a spaced-apart manner from a bottom surface portion of the room member.

5. An image display device according to claim 1, wherein the getter is arranged in a state that the getter faces a back surface of the back substrate.

6. An image display device according to claim 1, wherein a plurality of getter supports is provided and the respective flange portions of the plurality of getter supports are fixedly mounted on the housing by way of the sealing material.

7. An image display device according to claim 1, wherein an exhaust hole is formed in a bottom surface portion of the room member and an exhaust pipe is connected to the exhaust hole.

8. An image display device according to claim 1, wherein the room member is cup shape.

9. An image display device including a vacuum envelope in which a back substrate which forms electron emission sources thereon and a face substrate which forms an anode and phosphors thereon are arranged to face each other in an opposed manner, wherein a getter room which is communicated with the vacuum envelope is formed on a back surface of the back substrate, the getter room is constituted of a room member, a getter assembly is arranged in the inside of the getter room, and the getter assembly includes a getter, a getter housing which holds the getter, a getter support which supports the getter housing and a positioning rod which sets an arrangement position of the getter, wherein the room member includes a positioning groove in which a distal end portion of the positioning rod is inserted, and the distal end portion of the positioning rod is inserted into the inside of the positioning groove.

10. An image display device according to claim 9, wherein a through hole is formed in the back substrate so as to allow the getter room to be communicated with the vacuum envelope via the through hole.

11. An image display device according to claim 9, wherein the room member is formed by fixing a face plate and a frame using a sealing material and the positioning groove is formed in a sealing surface between the face plate and the frame.

12. An image display device according to claim 9, wherein the getter assembly includes a plurality of positioning rods and the room member includes a plurality of positioning grooves corresponding to the positioning rods.

13. An image display device according to claim 9, wherein an exhaust port is formed in a bottom surface portion of the room member and an exhaust pipe is connected to the exhaust port.

14. An image display device according to claim 9, wherein a shielding plate which blocks the scattering of the getter is arranged in the vicinity of the through hole.

* * * * *